US010373541B2

(12) United States Patent
Lee et al.

(10) Patent No.: US 10,373,541 B2
(45) Date of Patent: Aug. 6, 2019

(54) METHOD AND DEVICE FOR CONTROLLING DISPLAY OF DISPLAY DEVICE

(71) Applicant: SAMSUNG DISPLAY CO., LTD., Yongin-si, Gyeonggi-do (KR)

(72) Inventors: Changhoon Lee, Yongin-si (KR); Ilnam Kim, Yongin-si (KR); Jongin Baek, Yongin-si (KR); Wonsang Park, Yongin-si (KR)

(73) Assignee: Samsung Display Co., Ltd., Yongin-Si, Gyeonggi-do (KR)

( * ) Notice: Subject to any disclaimer, the term of this patent is extended or adjusted under 35 U.S.C. 154(b) by 124 days.

(21) Appl. No.: 15/353,765

(22) Filed: Nov. 17, 2016

(65) Prior Publication Data

US 2017/0193880 A1 Jul. 6, 2017

(30) Foreign Application Priority Data

Jan. 5, 2016 (KR) ..... 10-2016-0001125

(51) Int. Cl.
*G09G 3/20* (2006.01)

(52) U.S. Cl.
CPC ... *G09G 3/2003* (2013.01); *G09G 2300/0452* (2013.01); *G09G 2310/0291* (2013.01); *G09G 2320/0242* (2013.01); *G09G 2320/0646* (2013.01); *G09G 2320/0666* (2013.01); *G09G 2340/0457* (2013.01); *G09G 2340/06* (2013.01); *G09G 2360/144* (2013.01)

(58) Field of Classification Search
None
See application file for complete search history.

(56) References Cited

U.S. PATENT DOCUMENTS

| | | | | |
|---|---|---|---|---|
| 8,456,496 | B2 | 6/2013 | Credelle | |
| 8,736,641 | B2 | 5/2014 | Byun et al. | |
| 2005/0088385 | A1* | 4/2005 | Elliott | G09G 3/20 345/87 |
| 2009/0281604 | A1* | 11/2009 | De Boer | A61M 21/00 607/88 |

(Continued)

FOREIGN PATENT DOCUMENTS

| | | | |
|---|---|---|---|
| CN | 101984487 | A | 3/2011 |
| KR | 10-1146992 | B1 | 5/2012 |

(Continued)

*Primary Examiner* — Amare Mengistu
*Assistant Examiner* — Sarvesh J Nadkarni
(74) *Attorney, Agent, or Firm* — Lee & Morse, P.C.

(57) ABSTRACT

A display control method and device for controlling a display device. The display device includes a red sub pixel, a green sub pixel, a first blue sub pixel, and a second blue sub pixel emitting light having a different central wavelength from that of the first blue sub pixel. The display control includes setting a display mode of the display device as one of a first mode in which the first blue sub pixel is used to emit blue light, a second mode in which the second blue sub pixel is used, and a third mode in which both the first blue sub pixel and the second blue sub pixel are used; and sub pixel rendering data according to an arrangement of the red sub pixel, the green sub pixel, the first blue sub pixel, and the second blue sub pixel and converting rendered data into output data.

20 Claims, 17 Drawing Sheets

(56) References Cited

U.S. PATENT DOCUMENTS

| | | | | |
|---|---|---|---|---|
| 2010/0149204 | A1* | 6/2010 | Han | G09G 5/02 345/690 |
| 2011/0025960 | A1* | 2/2011 | Jepsen | G02F 1/133514 349/106 |
| 2011/0273494 | A1 | 11/2011 | Jun | |
| 2014/0098143 | A1 | 4/2014 | Lee et al. | |
| 2014/0232735 | A1 | 8/2014 | Jeong et al. | |
| 2015/0125086 | A1 | 5/2015 | Jeong et al. | |
| 2016/0121073 | A1 | 5/2016 | Mok et al. | |
| 2016/0133177 | A1 | 5/2016 | Won et al. | |

FOREIGN PATENT DOCUMENTS

| | | | |
|---|---|---|---|
| KR | 10-2014-0035239 | A | 3/2014 |
| KR | 10-2014-0044568 | A | 4/2014 |
| KR | 10-2014-0104624 | A | 8/2014 |
| KR | 10-1440773 | B1 | 9/2014 |
| KR | 10-2015-0051390 | A | 5/2015 |
| KR | 10-2016-0053359 | A | 5/2016 |
| KR | 10-2016-0055490 | A | 5/2016 |

* cited by examiner

METHOD AND DEVICE FOR CONTROLLING DISPLAY OF DISPLAY DEVICE

CROSS-REFERENCE TO RELATED APPLICATION

Korean Patent Application No. 10-2016-0001125, filed on Jan. 5, 2016, in the Korean Intellectual Property Office, and entitled: "Method and Device for Controlling Display of Display Device," is incorporated by reference herein in its entirety.

BACKGROUND

1. Field

One or more embodiments relate to methods and devices for controlling display of a display device.

2. Description of the Related Art

Among hormones secreted from the human body, melatonin serves as a biological clock. When night comes, melatonin is secreted all over the body and informs each part of the body that night has come. When melatonin is secreted, sleeping is induced.

When morning comes and light illuminates, secretion of melatonin is suppressed and a human wakes up from sleeping. A wavelength around 464 nm in particular suppresses secretion of melatonin in humans. Generally, since people recognize light having a central wavelength around 470 nm as blue light, light having a wavelength around 464 nm is considered to be blue light.

SUMMARY

According to one or more embodiments, a display control method of controlling a display of a display device, wherein the display device includes a red sub pixel, a green sub pixel, a first blue sub pixel, and a second blue sub pixel emitting light having a different central wavelength from that of the first blue sub pixel, the display control method including setting a display mode of the display device to emit blue light as one of a first mode in which the first blue sub pixel is used, a second mode in which the second blue sub pixel is used, and a third mode in which both the first blue sub pixel and the second blue sub pixel are used; and sub pixel rendering red input data, green input data, and blue input data according to an arrangement of the red sub pixel, the green sub pixel, the first blue sub pixel, and the second blue sub pixel and converting the red input data, the green input data, and the blue input data into output data, wherein the converting includes: performing sub pixel rendering by changing a size and a coefficient of a rendering filter with respect to each of the red input data, green input data, and blue input data according to the display mode.

When the display mode is the first mode, a size and a coefficient of a first rendering filter for converting the red input data into output data of the red sub pixel and a size and a coefficient of a second rendering filter for converting the blue input data into output data of the first blue sub pixel may be different.

The first rendering filter is a 2×1 filter and a coefficient of the 2×1 filter may be 0.5, and the second rendering filter is a 2×2 filter and a coefficient of the 2×2 filter may be 0.25.

When the display mode is the second mode, a size and a coefficient of a first rendering filter for converting the red input data into output data of the red sub pixel and a size and a coefficient of a third rendering filter for converting the blue input data into output data of the second blue sub pixel may be different.

The first rendering filter is a 2×1 filter and a coefficient of the 2×1 filter may be 0.5, and the third rendering filter is a 2×2 filter and a coefficient of the 2×2 filter may be 0.25.

When the display mode is the third mode, a size and a coefficient of a first rendering filter for converting the red input data into output data of the red sub pixel and a size and a coefficient of a fourth rendering filter for converting the blue input data into output data of the first blue sub pixel and the second blue sub pixel may be the same.

The first rendering filter and the fourth rendering filter may be 2×1 filters and a coefficient of the 2×1 filter may be 0.5.

A central wavelength of light emitted from the first blue sub pixel may be lower than a central wavelength of light emitted from the second blue sub pixel.

Setting the display mode may include determining a current state as daytime or night, if the current state is daytime, setting the display mode as the second mode or the third mode, and, if the current state is night, setting the display mode as the first mode.

Setting the display mode may include recognizing the current state as daytime or night based on at least one of a current time, a preset display mode change cycle, and external luminance and setting the display mode based on the recognized current state.

According to one or more embodiments, a display control device for controlling a display of a display device, wherein the display device includes a red sub pixel, a green sub pixel, a first blue sub pixel, and a second blue sub pixel emitting light having a different central wavelength from that of the first blue sub pixel, the display control device including a display mode controller for setting a display mode of the display device to emit blue light as one of a first mode in which the first blue sub pixel is used, a second mode in which the second blue sub pixel is used, and a third mode in which both the first blue sub pixel and the second blue sub pixel are used; and a data converter for sub pixel rendering red input data, green input data, and blue input data according to an arrangement of the red sub pixel, the green sub pixel, the first blue sub pixel, and the second blue sub pixel and converting the red input data, the green input data, and the blue input data into output data, wherein the data converter performs sub pixel rendering by changing a size and a coefficient of a rendering filter with respect to each of the red input data, green input data, and blue input data according to the display mode.

BRIEF DESCRIPTION OF THE DRAWINGS

Features will become apparent to those of skill in the art by describing in detail exemplary embodiments with reference to the attached drawings in which.

DETAILED DESCRIPTION

Figure 1:
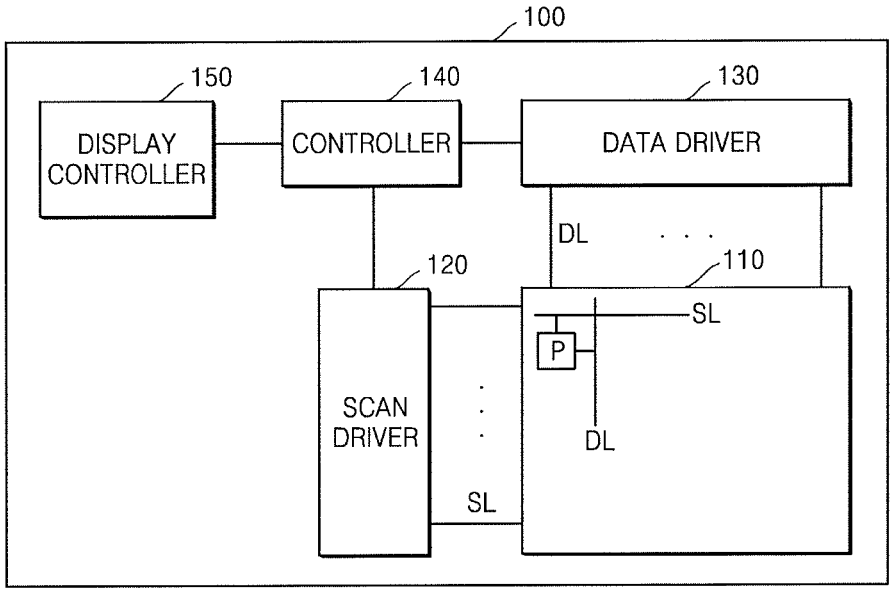
FIG. 1 illustrates a schematic diagram of a configuration of a display device according to an embodiment.

Example embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey exemplary implementations to those skilled in the art.

It will be understood that although the terms "first", "second", etc. may be used herein to describe various components, these components should not be limited by these terms. These components are only used to distinguish one component from another. As used herein, the singular forms "a," "an" and "the" are intended to include the plural forms as well, unless the context clearly indicates otherwise. It will be further understood that the terms "comprises" and/or "comprising" used herein specify the presence of stated features or components, but do not preclude the presence or addition of one or more other features or components.

Sizes of elements in the drawings may be exaggerated for convenience of explanation. In other words, since sizes and thicknesses of components in the drawings are arbitrarily illustrated for convenience of explanation, the following embodiments are not limited thereto. As used herein, the term "and/or" includes any and all combinations of one or more of the associated listed items. Expressions such as "at least one of" when preceding a list of elements, modify the entire list of elements and do not modify the individual elements of the list.

FIG. 1 is a schematic diagram of a configuration of a display device 100 according to an embodiment. Referring to FIG. 1, the display device 100 may include a display panel 110, a scan driver 120, a data driver 130, a controller 140, and a display controller 150. The display device 100 may be an organic light emitting display device.

The display panel 110 may include a plurality of scan lines SL approximately extending in a row direction, a plurality of data lines DL approximately extending in a column direction, and a plurality of pixels P. The pixels P may emit light according to signals applied thereto from the scan driver 120 and the data driver 130 to display an image. Although not shown, a plurality of light emitting control lines, power lines, and other signal lines may be further provided over the display panel 110. Each of the plurality of pixels P may have a pixel structure including one red sub pixel, one blue sub pixel, and two green sub pixels.

The data driver 130 may be connected to the plurality of data lines DL, may generate an analog or digital data signal from output data under control of the controller 140, and may supply the analog or digital data signal to the data lines DL.

The scan driver 120 may be connected to the plurality of scan lines SL, may generate a scan pulse under control of the controller 140, may sequentially supply scan signals to the scan lines SL, and may select a horizontal line to which a data signal is to be applied.

The controller 140 may control driving of the data driver 130 and the scan driver 120.

The display controller 150 may generally control display of the display device 100. According to an embodiment, the display controller 150 may set a display mode of the display device 100. The display controller 150 may select a sub pixel rendering algorithm according to the display mode to convert red, green, and blue input data r, g, and b that are input from an external device to output data R, G, B1, and B2 corresponding to a sub pixel structure (arrangement). The output data R, G, B1, and B2 may include luminance information of a sub pixel. Luminance may have a 1024($2^{10}$) grayscale, a 256($2^8$) grayscale, or a 64($2^6$) grayscale, etc.

The scan driver 120, the data driver 130, the controller 140, and the display controller 150 may be separate integrated circuit chips or one integrated circuit chip and may be directly mounted on one substrate forming the display panel 110, may be mounted over a flexible printed circuit film, may be attached to a substrate in a tape carrier package (TCP), or may be directly formed on the substrate.

The display device 100 according to an embodiment may provide a function of waking a viewer up or a function of not disturbing a viewer's sleep based on the emission or non-emission of light at a wavelength of around 464 nm to aid in regulating melatonin, which is a hormone that induces sleep.

The display device 100 according to an embodiment may include two types of blue sub-pixels having different central wavelengths. For example, the display device 100 may include a first blue sub pixel that emits first blue light having a central wavelength far from 464 nm and a second blue sub pixel that emits second blue light having a central wavelength close to 464 nm. For example, the first blue sub pixel may emit dark or deep blue light, and the second blue sub pixel may emit sky blue light. The central wavelength of the first blue light may be shorter than that of the second blue light. The central wavelength of the first blue light may have a value ranging from about 440 nm to about 450 nm. The central wavelength of the second blue light may have a value ranging from about 460 nm to about 470 nm. As an example, the first blue sub pixel and the second blue sub pixel may be formed such that the central wavelength of the first blue light is 450 nm, and the central wavelength of the second blue light is 464 nm.

Light emitted from the first blue sub pixel has the central wavelength far from 464 nm, the light may have little effect on secretion of melatonin. In contrast, light emitted from the second blue sub pixel has the central wavelength close to 464 nm, the light may suppress secretion of melatonin. Thus, the light emitted from the first blue sub pixel may produce an effect of not disturbing the viewer's sleep, i.e., as a result, an effect of inducing the viewer's sleep, and the light emitted from the second blue sub pixel may produce an effect of waking the viewer up. The display device 100 according to an embodiment may properly drive the two blue sub pixels according to the display mode, thereby providing the function of waking the viewer up or the function of not disturbing the viewer's sleep.

Figure 2A:
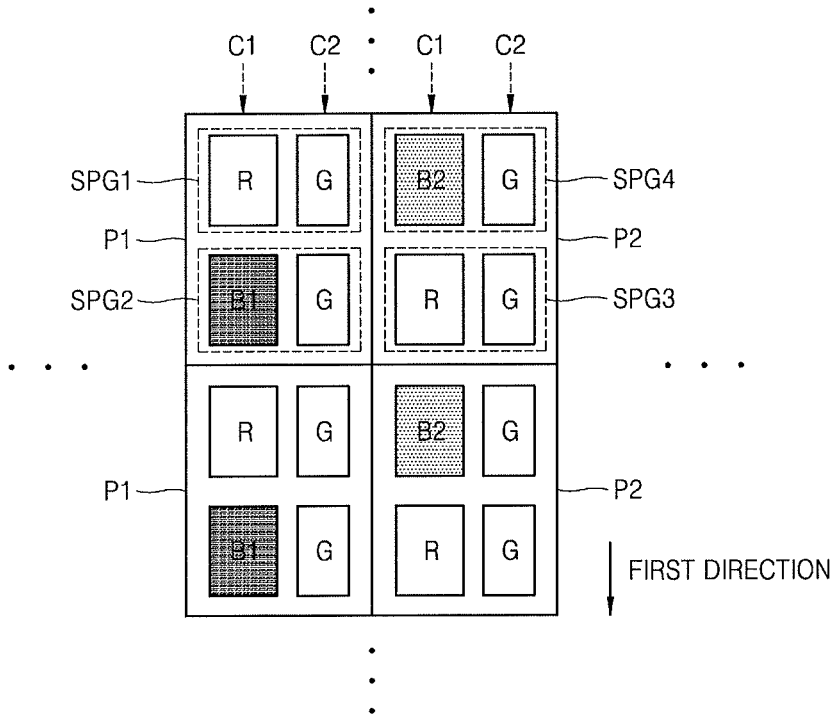
FIGS. 2A and 2B illustrate schematic diagrams of pixel structures according to an embodiment.
Figure 2B:
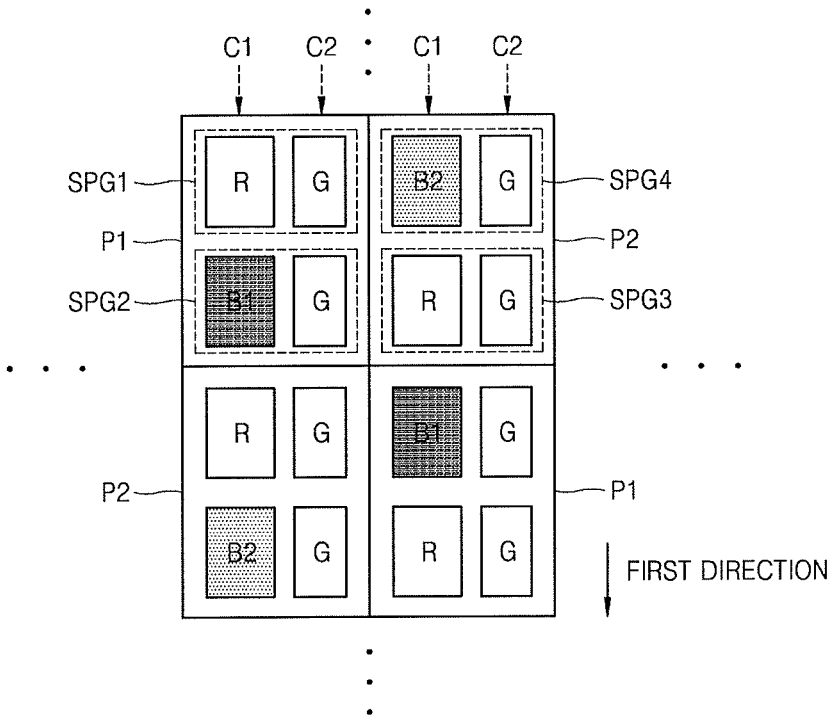

FIGS. 2A and 2B are schematic diagrams of pixel structures according to an embodiment. The pixel structures shown in FIGS. 2A and 2B are examples of a structure of pixels arranged in the display panel 110 according to an embodiment. A rectangular outline shown in FIGS. 2A and 2B indicates one pixel.

Referring to FIG. 2A, the display panel 110 may include a first pixel P1 and a second pixel P2. The first pixel P1 may include a red sub pixel (hereinafter a sub pixel R), a first blue sub pixel (hereinafter a sub pixel B1), and two green sub pixels (hereinafter sub pixels G). The second pixel P2 may include a sub pixel R, a second blue sub pixel (hereinafter a sub pixel B2), and two sub pixels G. Alternatively, two sub pixels may be grouped to form a unit pixel. The first pixel P1 may include a first sub pixel group SPG1 including the sub pixels R and G and a second sub pixel group SPG2 including the sub pixels B1 and G. The second pixel P2 may include a third sub pixel group SPG3 including the sub pixels R and G and a fourth sub pixel group SPG4 including the sub pixels B2 and G.

According to an embodiment, the first pixel P1 and the second pixel P2 may be adjacent to each other. Referring to FIG. 2A, a column of the first pixels P1 and a column of the second pixels P2 may be alternately disposed over the display panel 110 according to an embodiment.

Referring to FIG. 2A, the pixel structure of the display panel 110 according to an embodiment may be a structure in which a first sub pixel column C1 and a second sub pixel column C2 are alternately disposed. One of the sub pixels B1 and B2 may be alternately aligned with the sub pixels R aligned in a first direction in the first sub pixel column C1. The sub pixels G may be aligned in the first direction in the second sub pixel column C2. For example, in FIG. 2A, the sub pixels R and B1 are alternately aligned in the first sub pixel column C1 or the sub pixels R and B2 are alternately aligned in the first sub pixel column C1. In the particular example shown in FIG. 2A, the first pixel P1 having the sub pixels R and B1 may have the red sub pixel R in a first sub row thereof, with the blue sub pixel B1 in a second sub row thereof, and the second pixel P2 having the sub pixels R and B2 may have the blue sub pixel B2 in a first sub row thereof and a red sub pixel R in a second sub row thereof.

FIG. 2B is a diagram of a modification example of FIG. 2A. Referring to FIG. 2B, the first pixel P1 and the second pixel P2 having the same structure as shown in FIG. 2A may be alternately disposed such that the same pixels are not adjacent to each other either up and down or left and right. Referring to FIG. 2B, according to an embodiment, the first pixel P1 and the second pixel P2 may be alternately disposed in one pixel column of the display panel 110 and along one pixel row of the display panel 110, i.e., in the second direction orthogonal to the first direction.

Referring to FIG. 2B, the pixel structure of the display panel 110 according to an embodiment may be a structure in which the first sub pixel column C1 and the second sub pixel column C2 are alternately disposed. One of the sub pixels B1 and B2 and the sub pixels R may be alternately aligned in the first sub pixel column C1. In more detail, sub pixels may be aligned in an order of R, B1, R, and B2. The sub pixels G may be aligned in a first direction in the second sub pixel column C2.

Figure 3A:
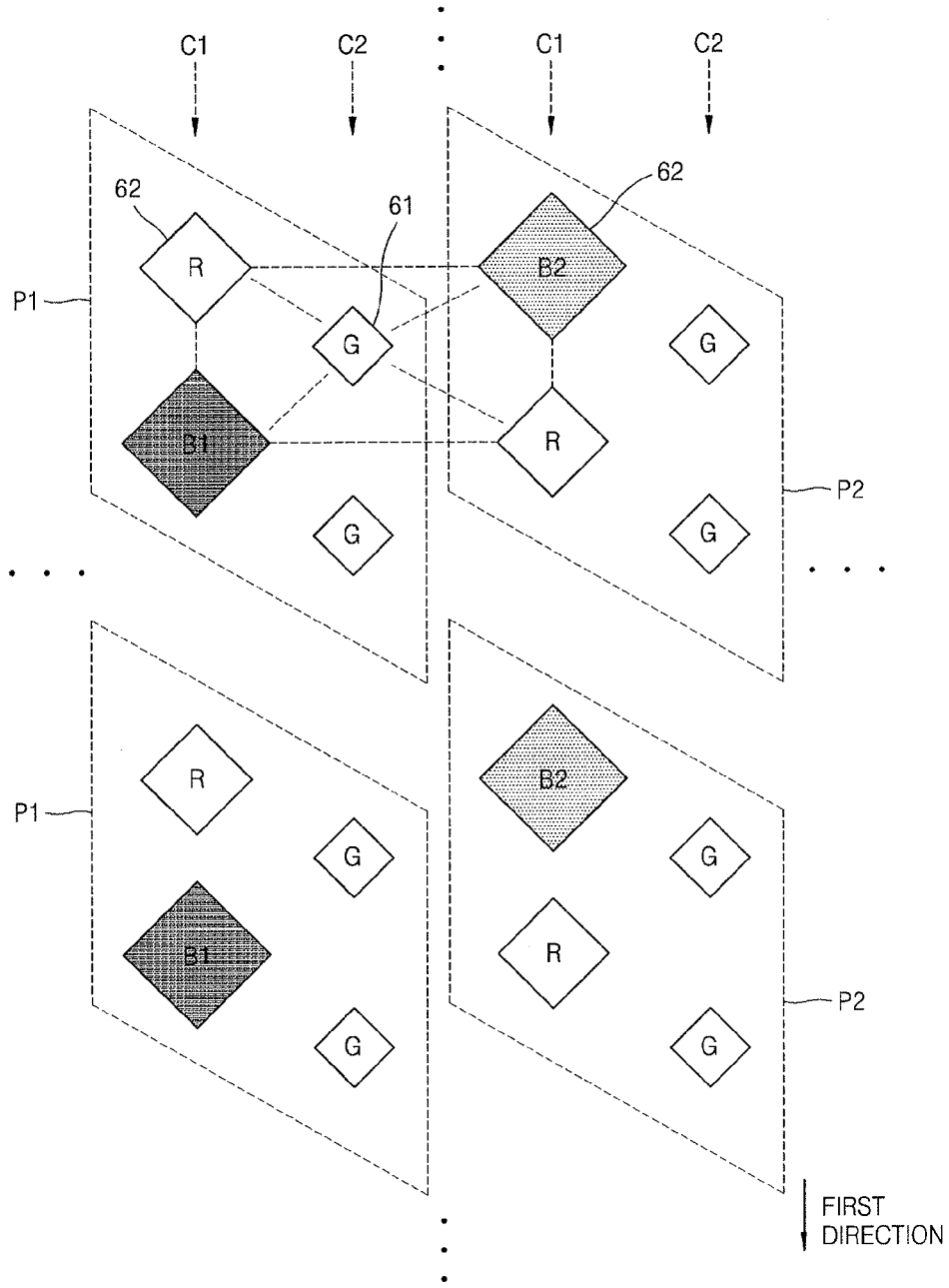
FIGS. 3A and 3B illustrate schematic diagrams of pixel structures according to another embodiment.
Figure 3B:
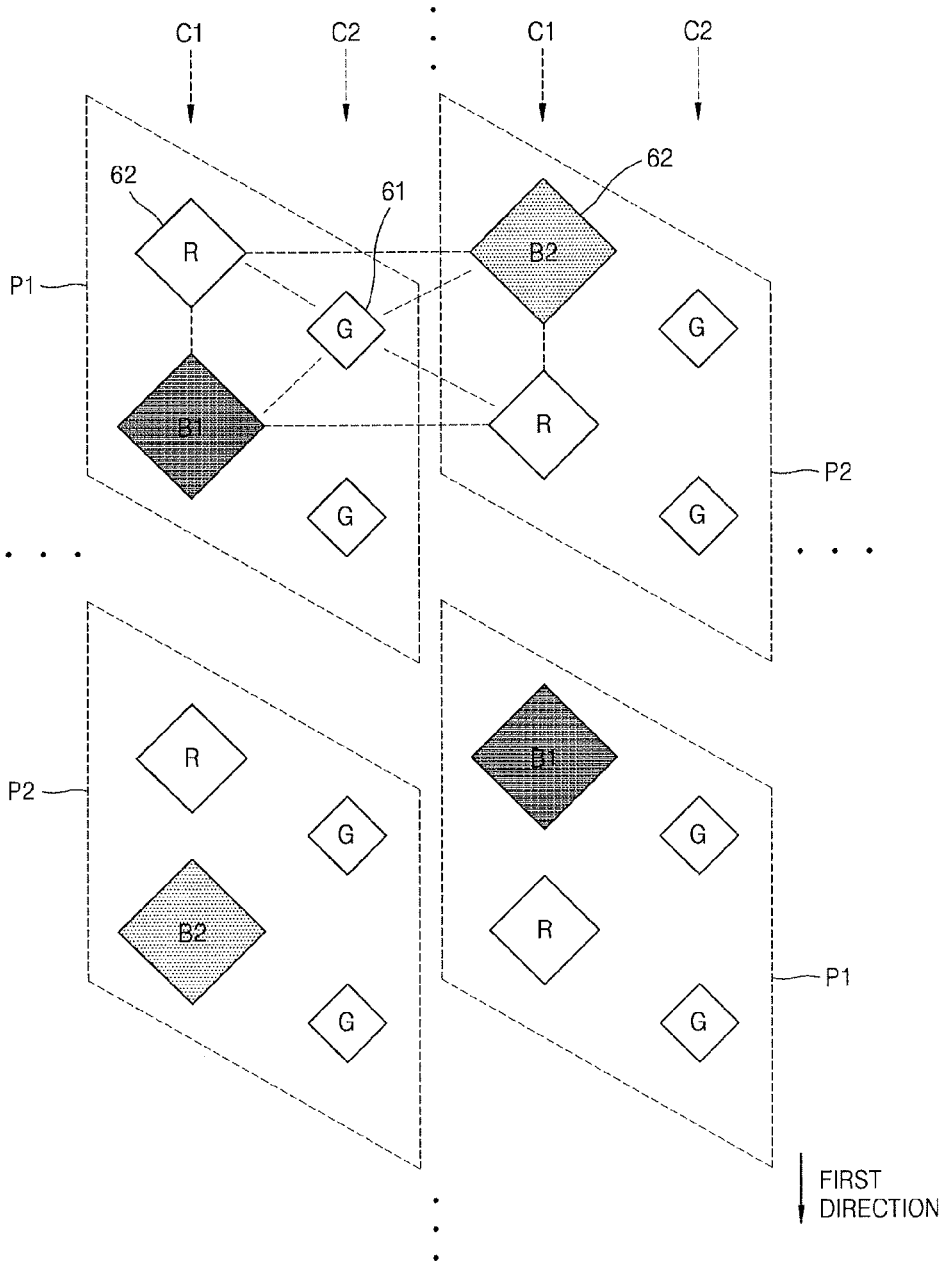

FIGS. 3A and 3B are schematic diagrams of pixel structures according to another embodiment. The pixel structures shown in FIGS. 3A and 3B are examples of a structure of pixels arranged in the display device panel 110 according to an embodiment. A large rectangular broken line shown in FIGS. 3A and 3B indicates one pixel.

Referring to FIG. 3A, the display panel 110 may include the first pixel P1 and the second pixel P2. The first pixel P1 may include the sub pixel R, the sub pixel B1, and two sub pixels G. The second pixel P2 may include the sub pixel R, the sub pixel B2, and two sub pixels G. According to an embodiment, the first pixel P1 and the second pixel P2 may be adjacent to each other. Referring to FIG. 3A, a column of the first pixels P1 and a column of the second pixels P2 may be alternately disposed over the display panel 110 according to an embodiment.

Referring to FIG. 3A, the pixel structure of the display panel 110 according to an embodiment may be a structure in which the first sub pixel column C1 and the second sub pixel column C2 are alternately disposed. One of the sub pixels B1 and B2 and the sub pixels R may be alternately aligned in a first direction in the first sub pixel column C1. The sub pixels G may be aligned in the first direction in the second sub pixel column C2. For example, in FIG. 3A, the sub pixels R and B1 are alternately aligned in the first sub pixel column C1, or the first sub pixel column C1 has one of two structures in which the sub pixels R and B2 are alternately aligned.

Unlike FIG. 2A, locations of sub pixels included in the first sub pixel column C1 and the second sub pixel column C2 may be across each other in the pixel structure of FIG. 3A. For example, sub pixels 62 included in the two first pixel columns C1 located at both sides of the second pixel column C2 may be disposed at one of four corners of rectangle, with respect to one sub pixel G 61 included in the second pixel column C2.

FIG. 3B is a diagram of a modification example of FIG. 3A. Referring to FIG. 3B, the first pixel P1 and the second pixel P2 may be alternately disposed such that the same pixels are not adjacent to each other either up and down or left and right. Referring to FIG. 3B, the first pixel P1 and the second pixel P2 may be alternately disposed in one pixel column of the display panel 110 according to an embodiment.

Referring to FIG. 3B, the pixel structure of the display panel 110 according to an embodiment may be a structure in which the first sub pixel column C1 and the second sub pixel column C2 are alternately disposed. One of the sub pixels B1 and B2 and the sub pixels R may be alternately aligned in the first sub pixel column C1. In more detail, sub pixels may be aligned in an order of R, B1, R, and B2. The sub pixels G may be aligned in a first direction in the second sub pixel column C2.

Figure 4:
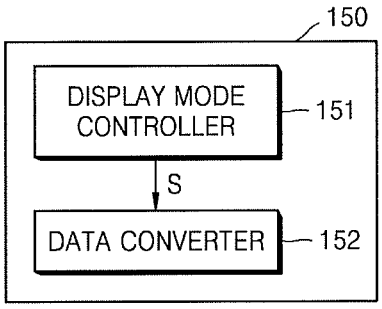
FIG. 4 illustrates a schematic block diagram of a configuration of a display controller according to an embodiment.

FIG. 4 is a schematic block diagram of a configuration of the display controller 150 according to an embodiment. Referring to FIG. 4, the display controller 150 of FIG. 4 may include a display mode controller 151 and a data converter 152.

The display controller 150 of FIG. 4 may include only constitutional elements related to the present embodiment in order to prevent obscuring features of the present embodiment. Thus, it will be understood by one of ordinary skill in the art that the display controller 150 may further include general constitutional elements in addition to the constitutional elements shown in FIG. 4.

The display controller 150 according to the present embodiment may correspond to one or more processors or include one or more processors. Accordingly, the display controller 150 may be driven and be included in another hardware device such as a microprocessor or a general computer system.

Referring to FIG. 4, the display controller 150 according to an embodiment may include the display mode controller 151 and the data converter 152. The display mode controller 151 and the data converter 152 may be separate semiconductor chips or may be integrated into one semiconductor chip.

The display mode controller 151 may set a display mode of the display panel 110. The display mode may be identified according to a driving scheme of a blue sub pixel. For example, the display mode may include a first mode in which only a first blue sub pixel B1 is used to display a blue color, a second mode in which only a second blue sub pixel B2 is used to display the blue color, and a third mode in which both the first blue sub pixel B1 and the second blue sub pixel B2 are used to display the blue color.

The display mode controller 151 may select, for example, the first mode to induce a user's sleep, the second mode to provide a wake-up effect to a user, or the third mode as a general display mode. The display mode may be selected according to a current time, external luminance sensed by a luminance sensor, or a mode change cycle set by the user. For example, the display mode controller 151 may select the second mode in the daytime and the first mode at night in relation to the current time. Alternatively, the display mode controller 151 may select the third mode irrespective of time. Alternatively, the display mode controller 151 may select the first mode when the external luminance is low and the second mode when the external luminance is high. Alternatively, the display mode controller 151 may select the display mode according to a display mode change cycle previously set by the user. Alternatively, the display mode controller 151 may change the display mode according to a user's selection.

The display mode controller 151 may generate and output a mode signal S indicating the selected display mode to the data converter 152.

The data converter 152 may receive the mode signal S and input data and may generate output data converted from the input data according to the display mode. The data converter 152 may output the output data to the data driver 130 through the controller 140. The data driver 130 may convert the output data into a data signal and apply the data signal to the display panel 110. The input data may be grayscale data of each of red, green, and blue colors. The output data may be grayscale data converted by sub pixel rendering the input data according to a pixel structure (a pixel arrangement).

The data converter 152 may apply a gamma function to the input data, i.e., the rendered grayscale data, convert the input data into brightness data, sub pixel render the brightness data, apply an inverse gamma function to the rendered brightness data, convert the brightness data into the grayscale data, and generate the output data.

A pixel driving method may be different depending on a type of the display mode of the display panel 110 described above. In more detail, a type of a pixel used to display an image, in particular, used to emit blue light, may be different according to the type of the display mode. The data converter 152 may generate the output data by sub pixel rendering the input data in correspondence to the display mode of the display panel 110. For example, when the display mode of the display panel 110 is the first mode, the data converter 152 may generate the output data by sub pixel rendering the input data such that the first blue sub pixel B1 is used. In this case, a pixel value of the second blue sub pixel B2 may be output as 0. When the display mode of the display panel 110 is the second mode, the data converter 152 may generate the output data by sub pixel rendering the input data such that the second blue sub pixel B2 is used. In this case, a pixel value of the first blue sub pixel B1 may be output as 0. When the display mode of the display panel 110 is the third mode, the data converter 152 may generate the output data by sub pixel rendering the input data such that both the first blue sub pixel B1 and the second blue sub pixel B2 are used.

That is, the data converter 152 may compensate for brightness by using reference input data (input data of a location corresponding to a location of a sub pixel that is to be rendered) and peripheral input data neighboring the reference input data for sub pixel rendering, thereby enhancing quality. The data converter 152 may render the first blue sub pixel B1 or the second blue sub pixel B2 by using reference blue input data and left, top, and diagonal blue input data and may render a red sub pixel by using reference red input data and left red input data or top and left red input data, in the first mode or the second mode. The data converter 152 renders the first blue sub pixel B1 or the second blue sub pixel B2 by using the reference blue input data and the left blue input data or top and left blue input data and may render the red sub pixel by using the reference red input data and the left red input data or top and left red input data, in the third mode.

Figure 5:
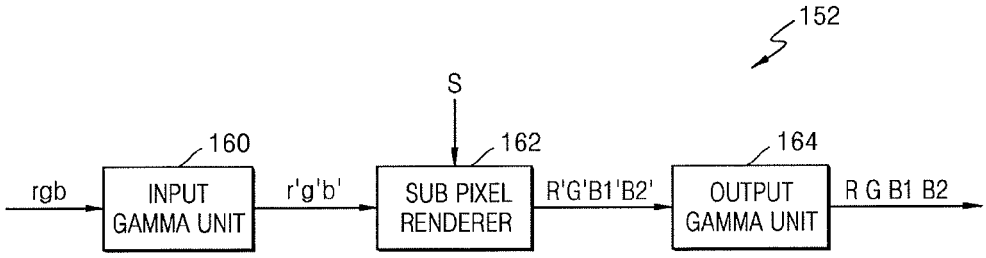
FIG. 5 illustrates a schematic block diagram of a configuration of a data converter according to an embodiment.
Figure 6:
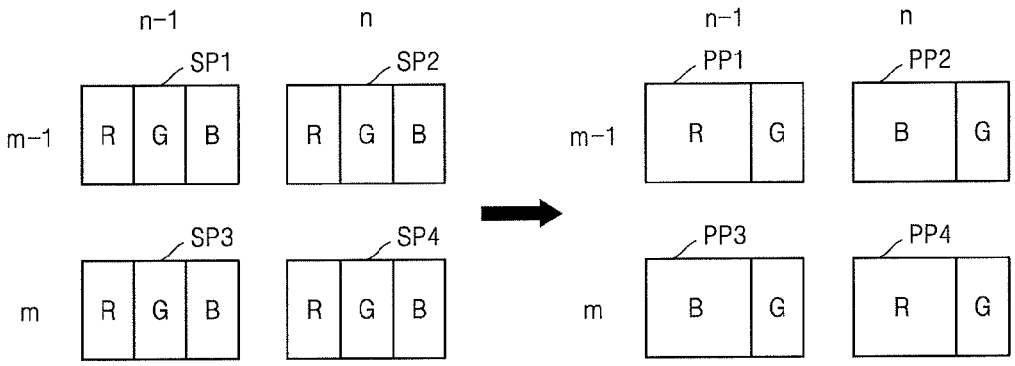
FIG. 6 illustrates a diagram for describing a sub pixel rendering method according to an embodiment.

FIG. 5 is a schematic block diagram of a configuration of the data converter 152 according to an embodiment. FIG. 6 is a diagram for describing a sub pixel rendering method according to an embodiment.

Referring to FIG. 5, the data converter 152 may include an input gamma unit 160, a sub pixel renderer 162, and an output gamma unit 164.

The input gamma unit 160 may apply a gamma function to RGB input data r, g, and b to linearize RGB input data. For example, the input gamma unit 160 may generate RGB input data r', g', and b' linearized by using the gamma function ($f=x^{2.2}$) that applies a reference gamma value (for example, 2.2) to each of the RGB input data r, g, and b.

The sub pixel renderer 162 may generate output data R', G', B1', and B2' linearized by sub pixel rendering the linearized RGB input data r', g', and b' to correspond to a sub pixel structure of the display panel 110. The sub pixel renderer 162 may recognize a display mode according to the mode signal S, select a sub pixel rendering algorithm for each sub pixel according to the display mode, and perform sub pixel rendering. The sub pixel renderer 162 may select a rendering filter that is to be used in the sub pixel rendering algorithm according to the display mode for each sub pixel. The size and number of rendering filters may be differently determined depending on the display mode and sub pixels.

The output gamma unit 164 may apply an inverse gamma function ($f=x^{1/2.2}$) to the linearized output data R', G', B1', and B2' to non-linearize the linearized output data R', G', B1', and B2', and generate output data R, G, B1, and B2.

The data converter 152 may generate output data B1 and B2 with respect to each of a first blue sub pixel and a second blue sub pixel when the display mode is a third mode. The data converter 152 may generate output data B1 and B2 such that a pixel value of a blue sub pixel (for example, the second blue sub pixel B2 in a first mode and the first blue sub pixel B1 in a second mode) of some pixels is 0 when the display mode is the first mode or the second mode.

The data converter 152 may perform outer edge compensation and dithering on image data including the output data R, G, B1, and B2.

Referring to FIG. 6, the data converter 152 may convert input data fit in a pixel structure of a stripe arrangement into output data fit in a pixel structure (of a pentile arrangement) shown in FIGS. 2 and 3. For convenience of description, it is assumed that the input data includes red, green, and blue color data r, g, and b. It is also assumed that an image in which the input data is implemented by pixels SP1, SP2, SP3, and SP4 of the stripe arrangement is the same as an image in which the output data is implemented by pixels PP1, PP2, PP3, and PP4 of the pentile arrangement.

The input pixel SP1 of an n−1th column and an m−1th row may correspond to the output pixel PP1 of the n−1th column and the m−1th row. The input pixel SP2 of an nth column and the m−1th row may correspond to the output pixel PP2 of the nth column and the m−1th row. The input pixel SP3 of the n−1th column and an mth row may correspond to the output pixel PP3 of the n−1th column and the mth row. The input pixel SP4 of the nth column and the mth row may correspond to the output pixel PP4 of the nth column and the mth row.

A size (area) of red sub pixels and blue sub pixels of the output pixels PP1, PP2, PP3, and PP4 may be twice a size of red sub pixels and blue sub pixels of the input pixels SP1, SP2, SP3, and SP4. A size of green sub pixels of the output pixels PP1, PP2, PP3, and PP4 may be the same as a size of green sub pixels of the input pixels SP1, SP2, SP3, and SP4.

The output pixels PP1, PP2, PP3, and PP4 may be sub pixel groups arranged in rows and columns corresponding to rows and columns of the input pixels SP1, SP2, SP3, and SP4. Two sub pixels of the output pixels PP1, PP2, PP3, and PP4 may correspond to three sub pixels of the input pixels SP1, SP2, SP3, and SP4.

The data converter 152 may convert a color expressed by sub pixels of the input pixels SP1, SP2, SP3, and SP4 into a color expressed by sub pixels of the output pixels PP1, PP2, PP3, and PP4.

The blue sub pixel B of the output pixels PP2 and PP3 may be the first blue sub pixel B1 or the second blue sub pixel B2.

Figure 7:
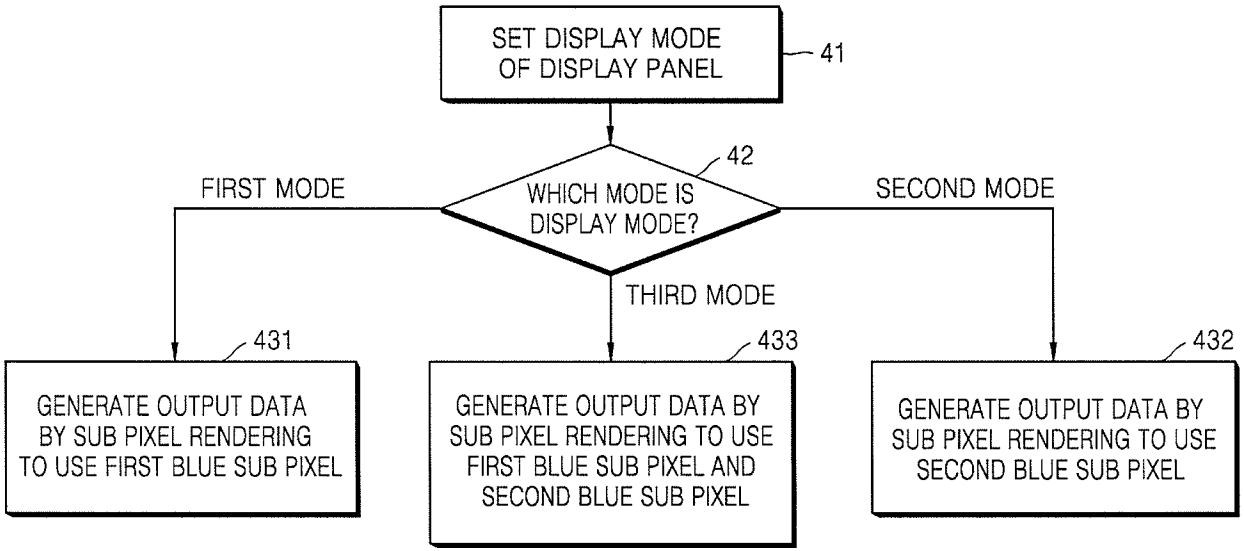
FIG. 7 illustrates a flowchart of a display control method performed by a display controller, according to an embodiment.
Figure 8A:
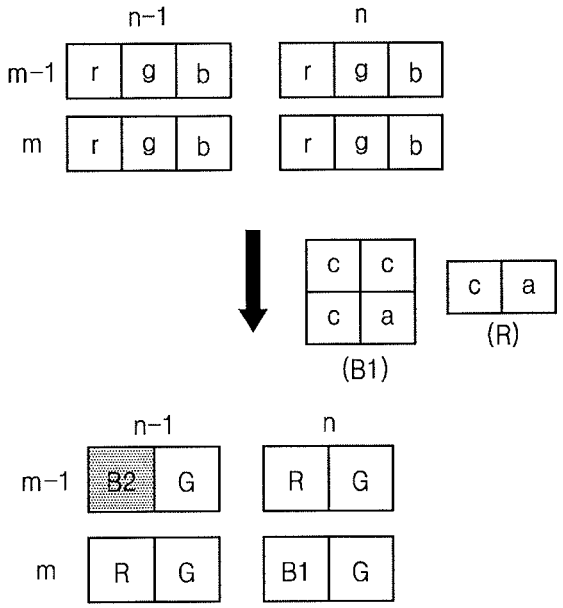
FIGS. 8A through 11B illustrate diagrams for describing a display control method performed by the display controller.

FIG. 7 is a flowchart of a display control method performed by the display controller 150, according to an embodiment. FIGS. 8A through 11B are diagrams for describing the display control method performed by the display controller 150. In FIGS. 8A and 9A, a shaded sub pixel indicates that it is not used to generate an image.

The flowchart of FIG. 7 includes operations that are serially processed by the display controller 150 of FIG. 4. Thus, although omitted below, the descriptions provided with reference to the configurations shown in FIG. 4 may apply to the method of FIG. 7.

Referring to FIG. 7, in operation 41, the display mode controller 151 may set a display mode of a display panel. The display mode controller 151 may set the display mode according to a current state. For example, the display mode controller 151 may determine the current state as daytime or nighttime. If the current state is daytime, the display mode may be set as a second mode or a third mode. If the current state is nighttime, the display mode may be set as a first mode. The display mode controller 151 may recognize the current state as daytime or nighttime based on at least one of a current time, a preset display mode change cycle, and external luminance.

In operation 42, the data converter 152 may proceed with one of operations 431 through 433 according to the set display mode of the display panel. When the display mode is the first mode, the data converter 152 may proceed with operation 431. When the display mode is the second mode, the data converter 152 may proceed with operation 432. When the display mode is the third mode, the data converter 152 may proceed with operation 433.

In operation 431, the data converter 152 may sub pixel render input data and generate output data such that an image is displayed by using a first blue sub pixel according to the first mode of the display mode. The data converter 152 may select a sub pixel rendering algorithm of the first mode. The data converter 152 may select a rendering filter for each sub pixel used in the selected sub pixel rendering algorithm. The data converter 152 may generate output data of a red sub pixel by applying a coefficient of a 2×1 rendering filter to red input data of a coordinate (a reference coordinate) corresponding to a location or a coordinate (column, row) of an output pixel and red input data of a coordinate adjacent to the reference coordinate in a left direction. The data converter 152 may generate output data of a blue sub pixel by applying a coefficient of a 2×2 rendering filter to blue input data of the reference coordinate corresponding to the location or the coordinate (column, row) of the output pixel and blue input data of coordinates adjacent to the reference coordinate in left, up, and diagonal directions. The data converter 152 may generate the output data of a green sub pixel which is the same as green input data of the reference coordinate corresponding to the location or the coordinate (column, row) of the output pixel.

Figure 8B:
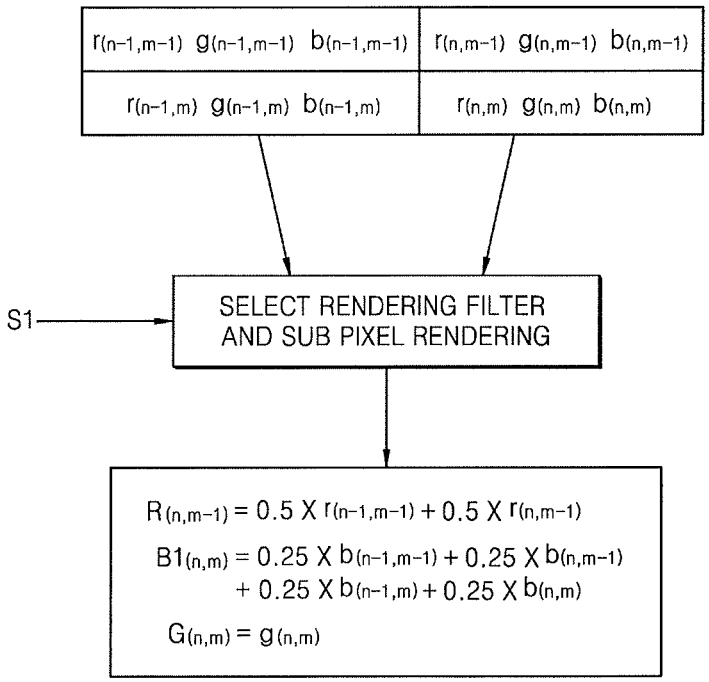
Figure 9A:
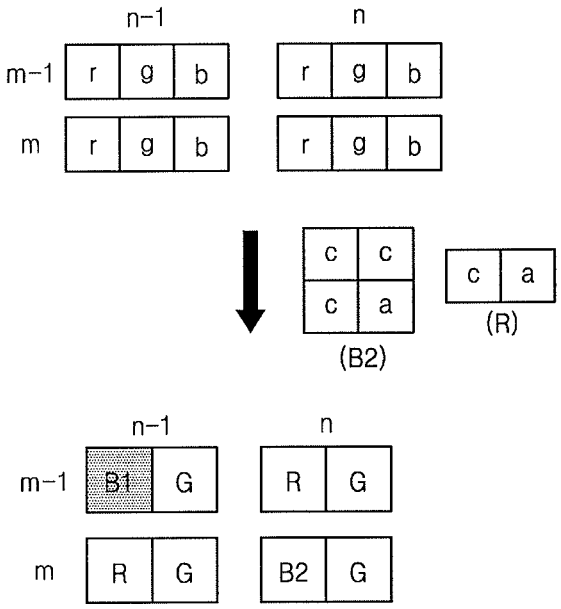

Referring to FIGS. 8A and 8B, the data converter 152 may receive a mode signal S1 of a first mode, select a rendering filter of each of a red sub pixel, a green sub pixel, and a blue sub pixel set in the first mode, and perform sub pixel rendering.

The data converter 152 may extract RGB input data necessary for sub pixel rendering from a two lines buffer (not shown) storing RGB input data of two rows.

For example, as shown in Equation 1 below, output data {R(n, m−1)} of the red sub pixel included in an output pixel of a coordinate (n, m−1) may be generated by applying a coefficient a(=0.5) of a 2×1 rendering filter to red input data {r(n, m−1)} of the corresponding reference coordinate (n, m−1) and applying a coefficient c(=0.5) of a 2×1 rendering filter to red input data {r(n−1, m−1)} of a coordinate (n−1, m−1) adjacent to a left direction.

$$R(n, m-1) = 255\left[0.5\left\{\frac{r(n-1, m-1)}{255}\right\}^{2.2} + 0.5\left\{\frac{r(n, m-1)}{255}\right\}^{2.2}\right]^{(1/2.2)} \quad (1)$$

As shown in Equation 2 below, output data {B1(n, m)} of a first blue sub pixel included in a pixel of a coordinate (n, m) may be generated by applying a coefficient a(=0.25) of a 2×2 rendering filter to blue input data {b(n, m)} of the corresponding reference coordinate (n, m) and applying a coefficient c(=0.25) of the 2×2 rendering filter to each of blue input data {b(n−1, m)} of a coordinate (n−1, m) adjacent to a left direction, blue input data {b(n, m−1)} of a coordinate (n, m−1) adjacent to an up direction, and blue input data {b(n−1, m−1)} of a coordinate (n−1, m−1) adjacent to a diagonal direction.

$$B1(n, m) = 255\left[0.25\left\{\frac{b(n-1, m-1)}{255}\right\}^{2.2} + 0.25\left\{\frac{b(n, m-1)}{255}\right\}^{2.2} + 0.25\left\{\frac{b(n-1, m)}{255}\right\}^{2.2} + 0.25\left\{\frac{b(n, m)}{255}\right\}^{2.2}\right]^{(1/2.2)} \quad (2)$$

As shown in Equation 3 below, output data {G(n, m)} of the green sub pixel included in a pixel of a coordinate (n, m) may be generated, which is the same as green input data {g(n, m)} of the corresponding reference coordinate (n, m). That is, the output data {G(n, m)} of the green sub pixel may use the input data as it is without a filter.

$$G(n,m)=g(n,m) \quad (3)$$

Output data of the second blue sub pixel included in the pixel of the coordinate (n−1, m−1) may be grayscale data of 0.

In operation 432, the data converter 152 may sub pixel render input data and generate output data such that an image is displayed by using the second blue sub pixel according to the second mode of the display mode. The data converter 152 may select a sub pixel rendering algorithm of the second mode to select a rendering filter for each sub pixel used in the selected sub pixel rendering algorithm. The data converter 152 may generate output data of the red sub pixel by applying the coefficient of the 2×1 rendering filter to red input data of a coordinate (a reference coordinate) corresponding to a location or a coordinate (column, row) of an output pixel and red input data of a coordinate adjacent to the reference coordinate in a left direction. The data converter 152 may generate output data of a blue sub pixel by applying the coefficient of the 2×2 rendering filter to blue input data of the reference coordinate corresponding to the location or the coordinate (column, row) of the output pixel and blue input data of coordinates adjacent to the reference coordinate in left, up, and diagonal directions. The data converter 152 may generate output data of the green sub pixel which is the same as the green input data of the reference coordinate corresponding to the location or the coordinate (column, row) of the output pixel.

Figure 9B:
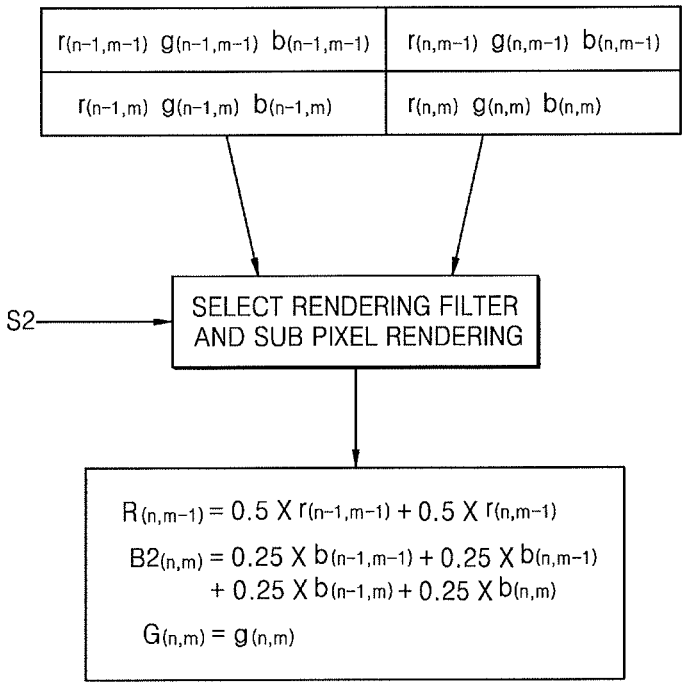

Referring to FIGS. 9A and 9B, the data converter 152 may receive a mode signal S2 of the second mode, select a rendering filter of each of a red sub pixel, a green sub pixel, and a blue sub pixel set in the second mode, and perform sub pixel rendering.

The data converter 152 may extract RGB input data necessary for sub pixel rendering from a two lines buffer (not shown) storing RGB input data of two rows.

For example, as shown in Equation 4 below, output data {R(n, m−1)} of the red sub pixel included in a pixel of a coordinate (n, m−1) may be generated by applying a coefficient a(=0.5) of a 2×1 rendering filter to red input data {r(n, m−1)} of the corresponding reference coordinate (n, m−1) and applying a coefficient c(=0.5) of a 2×1 rendering filter to red input data {r(n−1, m−1)} of a coordinate (n−1, m−1) adjacent to a left direction.

$$R(n, m-1) = 255\left[0.5\left\{\frac{r(n-1, m-1)}{255}\right\}^{2.2} + 0.5\left\{\frac{r(n, m-1)}{255}\right\}^{2.2}\right]^{(1/2.2)} \quad (4)$$

As shown in Equation 5 below, output data {B2(n, m)} of a second blue sub pixel included in a pixel of a coordinate (n, m) may be generated by applying a coefficient a(=0.25) of a 2×2 rendering filter to blue input data {b(n, m)} of the corresponding reference coordinate (n, m) and applying a coefficient c(=0.25) of a 2×2 rendering filter to each of blue input data {b(n−1, m)} of a coordinate (n−1, m) adjacent to a left direction, blue input data {b(n, m−1)} of a coordinate (n, m−1) adjacent to a top direction, and blue input data {b(n−1, m−1)} of a coordinate (n−1, m−1) adjacent to a diagonal direction.

$$B2(n, m) = 255\left[0.25\left\{\frac{b(n-1, m-1)}{255}\right\}^{2.2} + 0.25\left\{\frac{b(n, m-1)}{255}\right\}^{2.2} + 0.25\left\{\frac{b(n-1, m)}{255}\right\}^{2.2} + 0.25\left\{\frac{b(n, m)}{255}\right\}^{2.2}\right]^{(1/2.2)} \quad (5)$$

As shown in Equation 6 below, output data {G(n, m)} of the green sub pixel included in a pixel of a coordinate (n, m) may be generated, which is the same as green input data {g(n, m)} of the corresponding reference coordinate (n, m). That is, the output data {G(n, m)} of the green sub pixel may use the input data as it is without a filter.

$$G(n,m)=g(n,m) \quad (6)$$

Output data of the first blue sub pixel included in the pixel of the coordinate (n−1, m−1) may be grayscale data of 0.

In operation 433, the data converter 152 may sub pixel render input data and generate output data such that an image is displayed by using the first and second blue sub pixels according to the third mode of the display mode.

The data converter 152 may select a sub pixel rendering algorithm of the third mode to select a rendering filter for each sub pixel used in the selected sub pixel rendering algorithm.

The data converter 152 may generate output data of the red sub pixel by applying the coefficient of the 2×1 rendering filter to red input data of a coordinate (a reference coordinate) corresponding to a location or a coordinate (column, row) of an output pixel and red input data of a coordinate adjacent to the reference coordinate in a left direction. Likewise, the data converter 152 may generate output data of a blue sub pixel by applying the coefficient of the 2×1 rendering filter to blue input data of the reference coordinate corresponding to the location or the coordinate (column, row) of the output pixel and blue input data of a coordinate adjacent to the reference coordinate in the left direction. The data converter 152 may generate output data of the green sub pixel which is the same as the green input data of the reference coordinate corresponding to the location or the coordinate (column, row) of the output pixel.

Figure 10A:
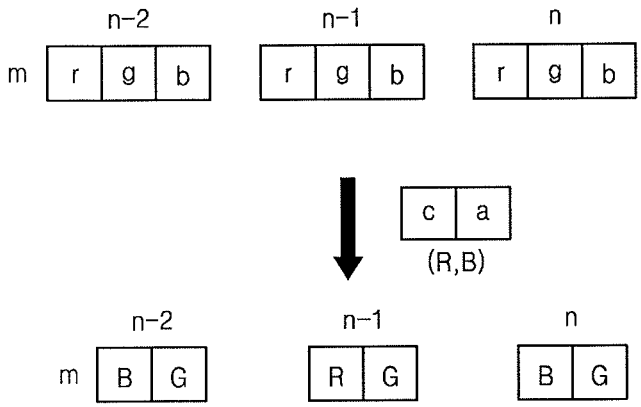
Figure 10B:
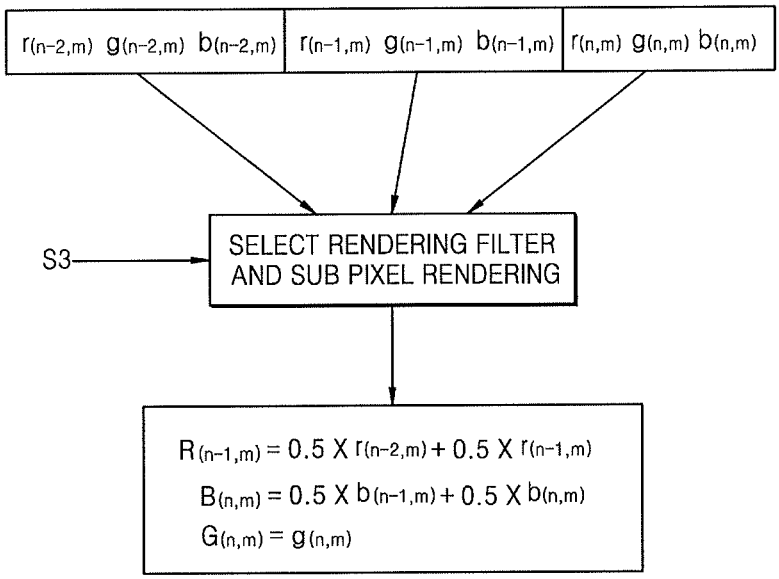

Referring to FIGS. 10A and 10B, the data converter 152 may receive a mode signal S3 of a third mode, select a rendering filter of each of a red sub pixel, a green sub pixel, and a blue sub pixel set in the third mode, and perform sub pixel rendering.

According to an embodiment, the data converter 152 may extract RGB input data necessary for sub pixel rendering from a line buffer (not shown) storing RGB input data of a one row.

For example, as shown in Equation 7 below, output data {R(n−1, m)} of the red sub pixel included in a pixel of a coordinate (n−1, m) may be generated by applying a coefficient a(=0.5) of a 2×1 rendering filter to red input data {r(n−1, m)} of the corresponding reference coordinate (n−1, m) and applying a coefficient c(=0.5) of a 2×1 rendering filter to red input data {r(n−2, m)} of a coordinate (n−2, m) adjacent to a left direction.

$$R(n-1, m) = 255\left[0.5\left\{\frac{r(n-2, m)}{255}\right\}^{2.2} + 0.5\left\{\frac{r(n-1, m)}{255}\right\}^{2.2}\right]^{(1/2.2)} \quad (7)$$

As shown in Equation 8 below, output data {B(n, m)} of the blue sub pixel (first and second blue sub pixels) included in a pixel of a coordinate (n, m) may be generated by applying a coefficient a(=0.5) of a 2×1 rendering filter to blue input data {b(n, m)} of the corresponding reference coordinate (n, m) and applying a coefficient c(=0.5) of a 2×1 rendering filter to blue input data {b(n−1, m)} of a coordinate (n−1, m) adjacent to a left direction.

$$B(n, m) = 255\left[0.5\left\{\frac{b(n-1, m)}{255}\right\}^{2.2} + 0.5\left\{\frac{b(n, m)}{255}\right\}^{2.2}\right]^{(1/2.2)} \quad (8)$$

As shown in Equation 9 below, output data {G(n, m)} of the green sub pixel included in a pixel of a coordinate (n, m) may be generated, which is the same as green input data {g(n, m)} of the corresponding reference coordinate (n, m). That is, the output data {G(n, m)} of the green sub pixel may use the input data as it is without a filter.

$$G(n,m)=g(n,m) \quad (9)$$

As another example, the data converter 152 may generate output data of the red sub pixel by applying the coefficient of the 2×2 rendering filter to red input data of a coordinate (a reference coordinate) corresponding to a location or a coordinate (column, row) of an output pixel and red input data of coordinates adjacent to the reference coordinate in left and top directions. Likewise, the data converter 152 may generate output data of a blue sub pixel by applying the coefficient of the 2×2 rendering filter to blue input data of the reference coordinate corresponding to the location or the coordinate (column, row) of the output pixel and blue input data of coordinates adjacent to the reference coordinate in the left and top directions. The data converter 152 may generate the output data of the green sub pixel which is the same as the green input data of the reference coordinate corresponding to the location or the coordinate (column, row) of the output pixel.

Compared to sub pixel rendering that uses a 2×2 rendering filter requiring a two lines buffer, when a 2×1 rendering filter is used, sub pixel rendering may be possible only by using a line buffer, thereby minimizing power consumption, memory, and an amount of calculation, and maximizing sharpness.

Figure 11A:
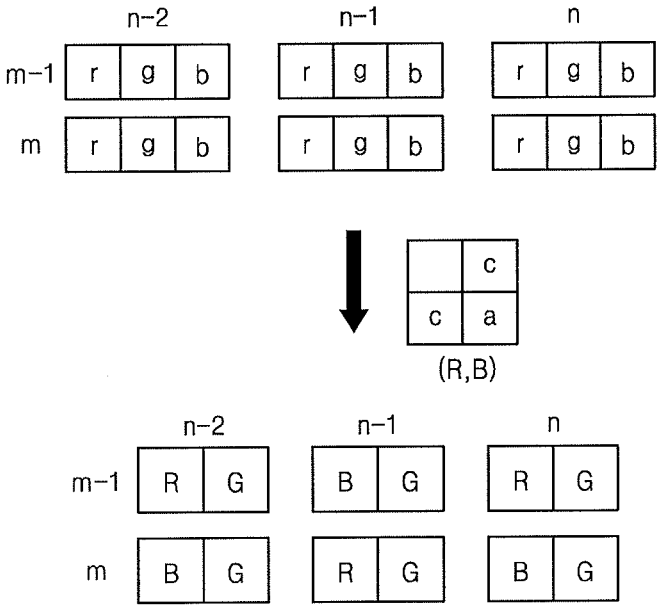
Figure 11B:
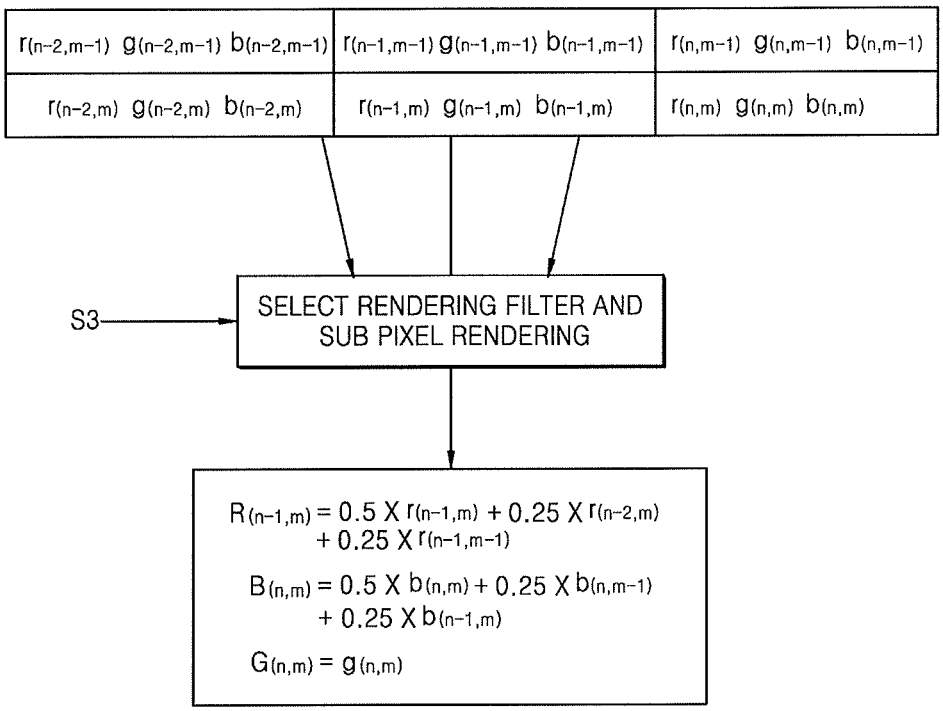

Referring to FIGS. 11A and 11B, the data converter 152 may receive the mode signal S3 of the third mode, select a rendering filter of each of a red sub pixel, a green sub pixel, and a blue sub pixel set in the third mode, and perform sub pixel rendering.

The data converter 152 may extract RGB input data necessary for sub pixel rendering from a two lines buffer (not shown) storing RGB input data of two rows.

For example, as shown in Equation 10 below, output data {R(n−1, m)} of the red sub pixel included in a pixel of a coordinate (n−1, m) may be generated by applying a coefficient a(=0.5) of a 2×2 rendering filter to red input data {r(n−1, m)} of the corresponding reference coordinate (n−1, m) and applying a coefficient c(=0.25) of a 2×2 rendering filter to each of red input data {r(n−2, m)} of a coordinate (n−2, m) adjacent to a left direction and red input data r(n−1, m−1)} of a coordinate (n−1, m−1) adjacent to a top direction.

$$R(n-1, m) = 255\left[0.5\left\{\frac{r(n-1, m)}{255}\right\}^{2.2} + 0.25\left\{\frac{r(n-2, m)}{255}\right\}^{2.2} + 0.25\left\{\frac{r(n-1, m-1)}{255}\right\}^{2.2}\right]^{(1/2.2)} \quad (10)$$

As shown in Equation 11 below, output data {B(n, m)} of the blue sub pixel (a first blue sub pixel or a second blue sub pixel) included in a pixel of a coordinate (n, m) may be generated by applying a coefficient a(=0.5) of a 2×2 rendering filter to blue input data {b(n, m)} of the corresponding reference coordinate (n, m) and applying a coefficient c(=0.25) of a 2×2 rendering filter to each of blue input data {b(n−2, m)} of a coordinate (n−2, m) adjacent to a left direction and blue input data {b(n, m−1)} of a coordinate (n, m−1) adjacent to a top direction.

$$B(n, m) = 255\left[0.5\left\{\frac{b(n, m)}{255}\right\}^{2.2} + 0.25\left\{\frac{b(n-1, m)}{255}\right\}^{2.2} + 0.25\left\{\frac{b(n, m-1)}{255}\right\}^{2.2}\right]^{(1/2.2)} \quad (11)$$

As shown in Equation 12 below, output data {G(n, m)} of the green sub pixel included in a pixel of a coordinate (n, m) may be generated, which is the same as green input data {g(n, m)} of the corresponding reference coordinate (n, m). That is, the output data {G(n, m)} of the green sub pixel may use the input data as it is without a filter.

$$G(n,m)=g(n,m) \quad (12)$$

In the Equations 1 through 11 of FIGS. 8A through 11B, for convenience of description, the application of a gamma function and an inverse gamma function and conversion of brightness data are omitted and output data that is sub pixel rendered is displayed as final grayscale data. In FIGS. 8A through 11B, 256 grayscales are described as an example but an embodiment is not limited thereto. Different grayscales may be expressed depending on a display device. Although output data rendering of a sub pixel included in an output pixel of a specific coordinate is described as an example with reference to FIGS. 8A through 11B, this may apply to output data rendering of a sub pixel included in an output pixel of a different coordinate.

When a display mode is a first mode and a second mode, sub pixel rendering of a red sub pixel using a 2×2 rendering filter shown in FIGS. 11A and 11B may apply to sub pixel rendering of the red sub pixel.

Sub pixel rendering is performed by using left input data of reference input data in the above-described embodiments but embodiments of are not limited thereto. Sub pixel rendering may be performed by using right input data of the reference input data. That is, the data converter 152 may render a first blue sub pixel or a second blue sub pixel by using reference blue input data and right, top, and diagonal blue input data and render a red sub pixel by using reference red input data and right or right and top red input data in a first mode or a second mode. The data converter 152 may render the first blue sub pixel or the second blue sub pixel by using the reference blue input data and the right or the right and top blue input data and render the red sub pixel by using the reference red input data and the right or the right and top red input data in a third mode.

In the embodiments, a pixel structure and a display mode in consideration of a recognition characteristic of a human being with respect to a blue wavelength band are implemented. Two blue sub pixels having different central wavelengths may be used to differentiate blue sub pixels used for each display mode. To prevent a yellowish phenomenon of a screen due to a reduction in resolution caused by different blue sub pixels, sub pixel rendering algorithms may be different for each display mode and sub pixel.

In the embodiments, sub pixel rendering may be performed using input data of two rows or input data of one row, and thus sub pixel rendering may be possible using a two lines buffer or a line buffer. Accordingly, a display device according to an embodiment may provide an image having an enhanced sharpness while reducing power consumption, memory, and an amount of calculations, compared to sub pixel rendering by a third line buffer.

The methods and processes described herein may be performed by code or instructions to be executed by a computer, processor, manager, or controller. Because the algorithms that form the basis of the methods (or operations of the computer, processor, or controller) are described in detail, the code or instructions for implementing the operations of the method embodiments may transform the computer, processor, or controller into a special-purpose processor for performing the methods described herein.

Also, another embodiment may include a computer-readable medium, e.g., a non-transitory computer-readable medium, for storing the code or instructions described above. The computer-readable medium may be a volatile or non-volatile memory or other storage device, which may be removably or fixedly coupled to the computer, processor, or controller which is to execute the code or instructions for performing the method embodiments described herein.

By way of summation and review, a method and device for controlling a display according to embodiments may provide a sleep-inducing function and/or a wake-up function according to a setting of a display mode. In more detail, a method and device for controlling a display according to embodiments may change and use a sub pixel rendering algorithm according to a setting of a display mode, thereby enhancing quality accompanied by a change in the display mode.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present invention as set forth in the following claims.

What is claimed is:

1. A display control method of controlling a display of a display device, wherein the display device includes a red sub pixel, a green sub pixel, a first blue sub pixel, and a second blue sub pixel emitting light having a different central wavelength from that of the first blue sub pixel, the method comprising:

setting a display mode of the display device to emit blue light as one of a first mode in which the first blue sub pixel is used, a second mode in which the second blue sub pixel is used, and a third mode in which both the first blue sub pixel and the second blue sub pixel are used; and sub pixel rendering red input data, green input data, and blue input data according to an arrangement of the red sub pixel, the green sub pixel, the first blue sub pixel, and the second blue sub pixel, and converting the red input data, the green input data, and the blue input data into output data, wherein converting includes performing sub pixel rendering by selecting a size and a coefficient of a rendering filter with respect to each of the red input data, green input data, and blue input data according to the display mode, and wherein a size and a coefficient of a rendering filter for the blue input data are different from a size and a coefficient of a rendering filter for the red input data in the first mode, and the size and the coefficient of the rendering filter for the blue input data are different from the size and the coefficient of the rendering filter for the red input data in the second mode.

2. The display control method as claimed in claim 1, wherein, when the display mode is the first mode, a size and a coefficient of a first rendering filter for converting the red input data into output data of the red sub pixel, and a size and a coefficient of a second rendering filter for converting the blue input data into output data of the first blue sub pixel are different.

3. The display control method as claimed in claim 2, wherein:

the first rendering filter is a 2×1 filter and a coefficient of the 2×1 filter is 0.5, and the second rendering filter is a 2×2 filter and a coefficient of the 2×2 filter is 0.25.

4. The display control method as claimed in claim 1, wherein, when the display mode is the second mode, a size and a coefficient of a first rendering filter for converting the red input data into output data of the red sub pixel and a size and a coefficient of a third rendering filter for converting the blue input data into output data of the second blue sub pixel are different.

5. The display control method as claimed in claim 4, wherein:

the first rendering filter is a 2×1 filter and a coefficient of the 2×1 filter is 0.5, and the third rendering filter is a 2×2 filter and a coefficient of the 2×2 filter is 0.25.

6. The display control method as claimed in claim 1, wherein, when the display mode is the third mode, a size and a coefficient of a first rendering filter for converting the red input data into output data of the red sub pixel, and a size and a coefficient of a fourth rendering filter for converting the blue input data into output data of the first blue sub pixel and the second blue sub pixel are the same.

7. The display control method as claimed in claim 6, wherein the first rendering filter and the fourth rendering filter are 2×1 filters and a coefficient of the 2×1 filter is 0.5.

8. The display control method as claimed in claim 1, wherein a central wavelength of light emitted from the first blue sub pixel is lower than a central wavelength of light emitted from the second blue sub pixel.

9. The display control method as claimed in claim 1, wherein setting the display mode includes:

determining a current state as daytime or night, if the current state is daytime, setting the display mode as the second mode or the third mode, and if the current state is night, setting the display mode as the first mode.

10. The display control method as claimed in claim 1, wherein setting the display mode includes:

recognizing a current state as daytime or nighttime night based on at least one of a current time, a preset display mode change cycle, and external luminance; and setting the display mode based on the recognized current state.

11. A display control device for controlling a display of a display device, wherein the display device includes a red sub pixel, a green sub pixel, a first blue sub pixel, and a second blue sub pixel emitting light having a different central wavelength from that of the first blue sub pixel, the display control device comprising:

a display mode controller to set a display mode of the display device to emit blue light as one of a first mode in which the first blue sub pixel is used, a second mode in which the second blue sub pixel is used, and a third mode in which both the first blue sub pixel and the second blue sub pixel are used; and a data converter to sub pixel render red input data, green input data, and blue input data according to an arrangement of the red sub pixel, the green sub pixel, the first blue sub pixel, and the second blue sub pixel, and to convert the red input data, the green input data, and the blue input data into output data, wherein the sub pixel rendering by the data converter includes selecting a size and a coefficient of a rendering filter with respect to each of the red input data, green input data, and blue input data according to the display mode, and wherein a size and a coefficient of a rendering filter for the blue input data are different from a size and a coefficient of a rendering filter for the red input data in the first mode, and the size and the coefficient of the rendering filter for the blue input data are different from the size and the coefficient of the rendering filter for the red input data in the second mode.

12. The display control device as claimed in claim 11, wherein, when the display mode is the first mode, a size and a coefficient of a first rendering filter for converting the red input data into output data of the red sub pixel, and a size and a coefficient of a second rendering filter for converting the blue input data into output data of the first blue sub pixel are different.

13. The display control device as claimed in claim 12, wherein:

the first rendering filter is a 2×1 filter and a coefficient of the 2×1 filter is 0.5, and the second rendering filter is a 2×2 filter and a coefficient of the 2×2 filter is 0.25.

14. The display control device as claimed in claim 11, wherein, when the display mode is the second mode, a size and a coefficient of a first rendering filter for converting the red input data into output data of the red sub pixel and a size, and a coefficient of a third rendering filter for converting the blue input data into output data of the second blue sub pixel are different.

15. The display control device as claimed in claim 14, wherein the first rendering filter is a 2×1 filter and a coefficient of the 2×1 filter is 0.5, and the third rendering filter is a 2×2 filter and a coefficient of the 2×2 filter is 0.25.

16. The display control device as claimed in claim 11, wherein, when the display mode is the third mode, a size and a coefficient of a first rendering filter for converting the red input data into output data of the red sub pixel and a size and a coefficient of a fourth rendering filter for converting the blue input data into output data of the first blue sub pixel and the second blue sub pixel are the same.

17. The display control device as claimed in claim 16, wherein the first rendering filter and the fourth rendering filter are 2×1 filters and a coefficient of the 2×1 filter is 0.5.

18. The display control device as claimed in claim 11, wherein a central wavelength of light emitted from the first blue sub pixel is lower than a central wavelength of light emitted from the second blue sub pixel.

19. The display control device as claimed in claim 11, wherein the display mode controller is to:

determine a current state as daytime or nighttime, if the current state is daytime, set the display mode as the second mode or the third mode, and if the current state is nighttime, set the display mode as the first mode.

20. The display control device as claimed in claim 11, wherein the display mode controller is to:

recognize a current state as daytime or nighttime based on at least one of a current time, a preset display mode change cycle, and external luminance, and set the display mode based on the recognized current state.

* * * * *